United States Patent [19]

Murray et al.

[11] 4,455,942

[45] Jun. 26, 1984

[54] TRAINING AMMUNITION

[75] Inventors: John Murray, Enfield; Robert W. Tobias, Waltham Abbey, both of England

[73] Assignee: The Secretary of State for Defence in Her Britannic Majesty's Government of the United Kingdom of Great Britain and Northern Ireland, London, England

[21] Appl. No.: 283,916

[22] Filed: Jul. 16, 1981

[30] Foreign Application Priority Data

Jul. 18, 1980 [GB] United Kingdom ..... 8023528

[51] Int. Cl.[3] ..... H04B 5/22

[52] U.S. Cl. ..... 102/444; 102/501; 102/529

[58] Field of Search ..... 102/501, 502, 511, 512, 102/513, 529, 439, 367, 370, 430, 444, 514–517, 530–532

[56] References Cited

U.S. PATENT DOCUMENTS

| | | | |
|---|---|---|---|
| 3,067,680 | 12/1962 | Lahr . | |
| 3,242,865 | 3/1966 | Jungermann . | |
| 3,598,058 | 8/1971 | Smith | 102/532 |
| 3,621,781 | 11/1971 | Johnsen | 102/439 |
| 3,706,278 | 12/1972 | Stiefel et al. | 102/430 |
| 3,732,821 | 5/1973 | Royer | 102/512 |
| 3,906,859 | 8/1971 | Smith . | |
| 3,935,816 | 2/1976 | Boquette, Jr. | 102/515 |
| 3,952,662 | 4/1976 | Greenlees | 102/502 |
| 3,982,489 | 9/1976 | Flateau . | |

FOREIGN PATENT DOCUMENTS

| | | |
|---|---|---|
| 445864 | 7/1912 | France . |
| 1381512 | 3/1965 | France . |
| 412639 | 11/1966 | Switzerland . |
| 413663 | 12/1966 | Switzerland . |
| 1152529 | 3/1967 | United Kingdom . |
| 1080219 | 8/1967 | United Kingdom . |
| 1085253 | 9/1967 | United Kingdom . |
| 1149034 | 4/1969 | United Kingdom . |
| 1272755 | 5/1972 | United Kingdom . |
| 1316784 | 5/1973 | United Kingdom . |
| 1444738 | 8/1976 | United Kingdom . |

*Primary Examiner*—Harold J. Tudor

*Attorney, Agent, or Firm*—Cushman, Darby & Cushman

[57] ABSTRACT

A round of ammunition for use in training comprises a standard brass cartridge case (1) containing a reduced propellant charge (14) and a bullet (2) of standard shape comprising a core (3) of rigid polyurethane foam and an external skin (14) of unfoamed polyurethane. The core and skin can be moulded integrally. The round is designed for firing in an automatic weapon and actuating its automatic mechanism. The skin of the bullet should be not less than 0.02 mm thick to withstand handling, and not more than 0.10 mm thick to avoid production of large fragments thereof on firing. The bullet can have opposite ends both of ogival form to facilitate manufacture and operation. The round is mainly for small arms up to 10 mm caliber.

8 Claims, 3 Drawing Figures

TRAINING AMMUNITION

Figure 1:
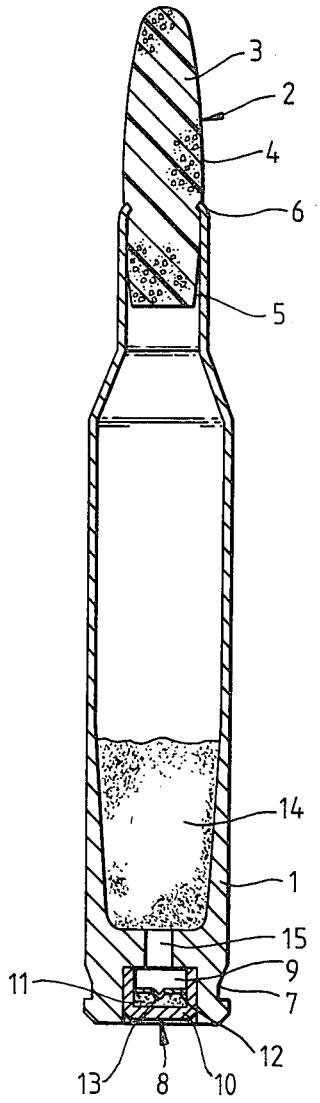

This invention relates to ammunition for use in training exercises.

In military training it is highly desirable that weapons should function as realistically as possible without presenting a safety hazard. Thus, a suitable round of ammunition for training purposes is one which will not project a bullet or debris which could endanger those taking part in the exercise.

In order to simulate normal operation of a firearm as closely as possible a training round should as far as possible produce the same sound effect, the same recoil of the firearm, and in the case of an automatic weapon should be capable of actuating the automatic mechanisms in the same way as the normal ammunition which the firearm is intended to use. Various forms of training round have been used in the past with these ends in view, but all have suffered from some disadvantage or another.

One method is to provide a round in which the brass cartridge case is extended and crimped over at its forward end to approximate the overall shape of a standard bulleted round. A round of this form is rather difficult to manufacture in that the bullet form requires deep drawing down to a narrow diameter. Also this form leaves a spent case which is considerably longer than that of a standard round, and is therefore more difficult to eject.

Another known method is to replace the normal bullet by a wooden one, the object being to ensure that the bullet disintegrates on firing. This type of practice round normally requires use of a special baffle at the muzzle to confine particles of wood. If a standard cartridge case is used the problem of ejection is overcome, but the need for a special baffle can be inconvenient. Moreover, it is found in practice that even when a baffle is used there is a danger of high velocity wood splinters escaping, and fragments of wood remaining within parts of the gun and baffle must be cleaned out fairly often.

The Applicant has also carried out some trials using a plastics-bodied cartridge case with an integrally moulded solid plastics bullet attached thereto by a weakened section. Prima facie this arrangement ought to permit an inexpensive construction but in practice this has been found not to be so, partly because of the need to include a machined metal primer case. Also, the plastic cases are readily deformed by firing and passage through the loading and unloading mechanism of the firearm, so that ejection can be difficult and the mechanism tends to jam. Also debris from the plastic bullet can tend to foul the parts of the firearm, requiring frequent clearing.

There is thus a need for a training round which can create the desired degree of realism with the maximum possible degree of safety. It is a great advantage if the training round can incorporate a standard cartridge case, so that the need for special arrangements to manufacture a special case can be avoided. In order to permit a smooth loading into a standard firearm, where appropriate from a standard magazine, the overall shape of the round should be substantially the same as that of a standard round, but the bullet portion should be such as (i) adequately to withstand any rough handling it may receive up to when it is chambered for firing; and (ii) to be consumed as completely as possible on firing preferably prior to exit from the muzzle, and certainly within a short distance from the muzzle.

The practice round should be capable of actuating any automatic or self loading mechanism without the need for any special attachment, except of course that a blank firing attachment which throttles the muzzle will probably always be necessary for this purpose.

According to one aspect, the present invention seeks to provide a blank training round which possesses at least some of the characteristics outlined hereinbefore as being desirable.

According to the present invention, a round of ammunition for use in training has a cartridge case, and a bullet fitted to seal the cartridge case, the bullet comprising a core of polyurethane foam and an external skin of unfoamed polyurethane.

Conveniently, the core and skin of the bullet are an integral moulding.

The thickness of the skin should normally be in the range 0.02 to 0.10 mm, preferably 0.04 to 0.05 mm.

The calibre of the round will normally not be greater than 10 mm.

The invention also provides, according to another aspect thereof, a device for feeding ammunition to an automatic firearm, said device containing a plurality of rounds of ammunition in accordance with the invention.

According to a further aspect of the invention there is provided a bullet comprising a core of polyurethane foam and an external skin of unfoamed polyurethane.

The bullet can be of ogival form, or can have opposite ends each of ogival form.

According to a still further aspect thereof, the invention provides a method of operating an automatic firearm, said firearm being capable of firing in rapid succession a plurality of rounds of ammunition, each said round being of a particular size and external shape and comprising a cartridge case of a particular size and external shape, the firearm being capable of ejecting automatically each cartridge case after firing and automatically preparing another round for firing, wherein the method of operating comprises supplying to the firearm in succession for firing a plurality of rounds of ammunition of the said size and external shape, each said round comprising a cartridge case of the said size and external shape and containing an explosive charge, and a bullet having a core of polyurethane foam and an external skin of unfoamed polyurethane.

Figure 2:
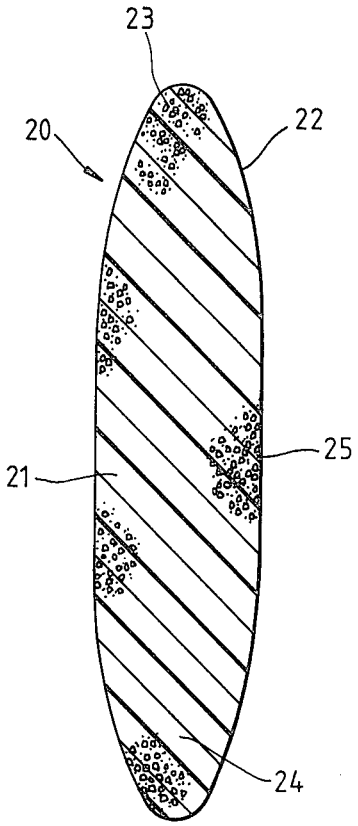

The invention will now be described by way of example only, with reference to the accompanying drawings, of which FIG. 1 is an axial sectional view of a round of ammunition in accordance with the invention, and FIG. 2 is an axial section of an alternative form of polyurethane bullet in accordance with the invention.

Figure 3:
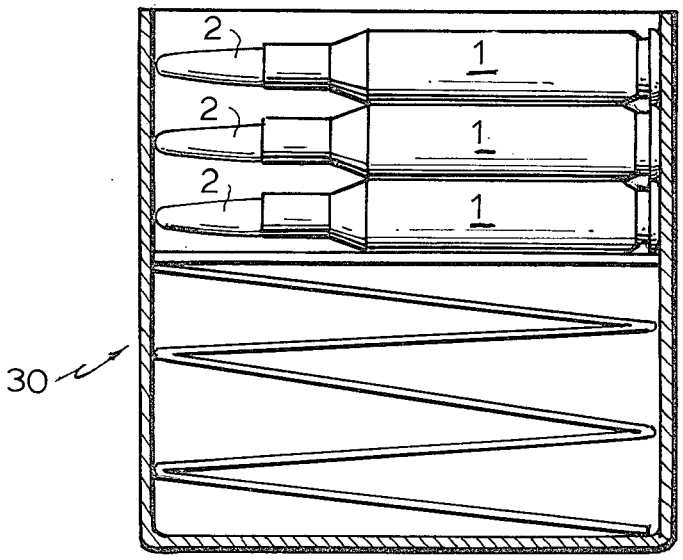

FIG. 3 is a cross sectional elevational view of a magazine containing plural rounds of ammunition in accordance with the present invention.

As shown in FIG. 1, the round comprises a brass cartridge case 1 of standard form as used for live ammunition, and a consumable bullet 2 of ogival form comprising a core of foamed polyurethane 3 and an integral skin 4 of unfoamed (ie fully dense) polyurethane. The polyurethane material contains 2% lamp black for colouring and hence greater realism. The bullet 2 has a chamfered rear end portion 5 to facilitate its insertion into the open forward end of the cartridge case 1. The bullet is fitted to the cartridge case by crimping the forward end portion 6 thereof after insertion of the bullet in like manner to fitting of a standard bullet in a live round. The material of the bullet 2 is thus deformed inwards and a seal formed between the bullet and the case.

The cartidge case 1 is provided in the usual way with a cannelure 7 to facilitate loading and unloading, and a primer cap 8 received in a recess 9 in the case 1. The primer cap 8 comprises a casing 10 which is a press fit in the recess 9, containing a quantity of primary explosive 11 and closed by a closure member 12 having an integral anvil 13.

The cartridge case is partially filled with a quantity of propellant 14 which is considerably less than is used for a normal live round, for example ⅔ the normal weight. The recess 9 communicates with the interior of the cartridge case 1 through a bore 15. No solid material is interposed between the explosive charge and the bullet.

When the primer cap 8 is struck as by the firing pin of a firearm, the primary explosive 1 is nipped between anvil 13 and casing 10, and hence detonates; the closure member 12 is ruptured; and a flame passes through the bore 15 to ignite the reduced propellant charge 14. This is a normal sequence of events on firing a round of ammunition. The pressure of gas generated by the burning propellant charge causes the bullet to separate from the case 2 and to be projected down the barrel of the firearm.

However, because of the special material and construction of the bullet 2, the bullet is consumed during the course of its passage along the barrel or within a short distance after exit therefrom. The mechanism by which the bullet is consumed is not wholly understood but it is thought that the explosive force of the propellant either vaporises or shatters the bullet into minute particles which readily burn in the hot wash of propellant gas. Polyurethane requires very little oxygen for its combustion, a factor which may assist the bullet in being consumed.

The bullet 2 itself is conveniently and cheaply made by a low pressure moulding process in which the polyurethane material is foamed in situ in a mould, the charge placed in the mould being such a quantity in relation to the mould size that on foaming the charge is confined by the mould surface so that a thin dense skin of polyurethane is formed on the mould surface with an inner core of rigid polyurethane foam. Conditions must be such that the skin is not unduly thick, otherwise the skin may fail to disintegrate or vaporise thoroughly on firing, so that relatively large particles of the skin are either projected a substantial distance or remain within to foul parts of the firearm. Factors which affect the skin thickness are the mass of the charge in relation to the mould size the nature of the foam-producing mixture (ie the charge), the temperature of the charge at entry to the mould, and the temperature of the mould. The skin should be sufficiently thick to withstand any rough handling which can be anticipated prior to firing—eg in the action of chambering and any automatic loading or feeding from a magazine. These factors mean the skin thickness should normally be in the range of 0.02 to 0.10 mm with thicknesses less than 0.06 mm preferred. In many cases the best compromise will be obtained with a skin thickness of 0.04 to 0.05 mm.

In practical tests, bullets of 5.56 mm calibre have been moulded from Components A and B of Isofoam 120, a commercial trade product of the Baxenden Chemical Company. The mixture of Components A and B is capable of generating polyurethane foam, and includes carbon black for the purpose of inhibiting the degradation in natural light which otherwise occurs in polyurethane. The 5.56 mm calibre bullets were moulded using between 0.07 and 0.09 gm of the mixture of Components A and B. The mould was at room temperature, and the mixture charged into the mould at 25° C. It will be observed that the mass of polyurethane forming a bullet is very small.

In firing tests, training rounds of the form herein described with reference to the figure and incorporating the 5.56 mm bullets just described were loaded into a magazine 30 (see FIG. 3) and fired from an automatic weapon with a blank firing attachment (ie a muzzle throttle). The automatic feed, loading and ejection mechanisms were all found to operate satisfactorily and the sound and recoil effects were similar to those of a normal live round. A paper screen placed 5 m in front of the muzzle of the firearm showed no damage or marking. Little or no fouling of any part of the gun or blank firing attachment was noted.

It will thus be aparent that training rounds in accordance with the invention can be economic to produce, requiring only a standard cartridge case with a cheaply moulded polyurethane bullet. The bullet is safely consumed in firing. The round can be used in a standard feeding device such as a magazine or feed belt for use with a standard automatic weapon, the only modification required being the addition of a standard blank firing attachment where automatic or self-loading operation is required—this being necessary with all known forms of blank round. With this modification, full self-loading and automatic action can be retained. Little or no fouling of the gun mechanism or the blank firing attachment can be expected.

It can be anticipated that the invention will be equally successful with other calibre of small arms, although it is though that with calibres in excess of 10 mm it may prove impossible to design a round so that the bullet is adequately consumed within an acceptably short distance.

In FIG. 2 there is shown an alternative form of bullet 20 which can replace the bullet 2 shown in FIG. 1. Like the bullet 2, the bullet 20 has a core 21 of rigid polyurethane foam and skin 22 of unfoamed polyurethane moulded integrally therewith. The bullet 20 comprises opposite end portions 23, 24 each of similar ogival form linked by a short cylindrical portion 25. The bullet 20 is thus of the general shape of two standard bullets joined back to back. In use the cylindrical portion 25 is held by crimping the forward portion 6 of the cartridge case leaving the same external shape to the round as shown in FIG. 1.

This arrangement can have a number of practical advantages. In automatic assembly of the rounds, it does not matter which way round the bullet 20 is fed and offered for assembly to the cartridge case 1. This simplifies mechanical handling. Furthermore, with a bullet 2 of the same size as a normal bullet in a live round, but the mass of propellant 14 reduced, a relatively larger space remains for the propellant to shift about in the case. This can lead to inefficient combustion of the propellant on firing. The "double-ended" bullet 20 partially fills the cartridge case, so somewhat restraining the propellant. Moulding very low mass bullets poses some difficulty, and the use of a larger, double bullet, eases the difficulty to a certain extent.

Other modifications within the scope of the invention will be evident to those skilled in the art.

We claim:

1. A practice round of small arms ammunition of a calibre up to 10 mm for increased safety in training with an automatic firearm said round comprising a cartridge case, a quantity of propellant material means within the case, and bullet means fitted at the forward end of the case to seal the propellant material within the case, the bullet means consisting solely of a core of foamed polyurethane material and an external skin of unfoamed polyurethane, any space between the propellant material and the bullet means being entirely free from solid material, wherein on firing the round the propellant material means ignites to produce high energy gases which act directly upon the bullet means to project the bullet means from the case and to consume the bullet means when thus projected from the case.

2. A round of ammunition according to claim 1 wherein said core and said skin are an integral moulding.

3. A round of ammunition according to claim 1 wherein the thickness of the skin is in the range of 0.02 to 0.10 mm.

4. A round of ammunition according to claim 1 wherein the thickness of the skin is in the range 0.04 to 0.05 mm.

5. A round of ammunition according to claim 1 wherein the bullet is of ogival form.

6. A round of ammunition according to claim 1 wherein the bullet has opposite ends each of ogival form.

7. A magazine for storing rounds of ammunition for feeding the rounds of ammunition to an automatic firearm, said magazine containing a plurality of rounds of ammunition, each said round being of a calibre up to 10 mm and comprising a cartridge case, a quantity of propellent material means within the case, and bullet means fitted at the forward end of the case to seal the propellant material within the case, the bullet means consisting solely of a core of foamed polyurethane material and an external skin of unfoamed polyurethane, any space between the propellant material and the bullet means being entirely free from solid material, wherein on firing each said round the propellant material means ignites to produce high energy gases which act directly upon the bullet means to project the bullet means from the case and to consume the bullet means when thus projected from the case.

8. A method of operating an automatic firearm, said firearm being capable of firing in rapid succession a plurality of rounds of ammunition of a calibre up to 10 mm each said round being of a particular size and external shape and comprising a cartridge case of a particular size and external shape, the firearm being capable of ejecting automatically each cartridge case after firing and automatically preparing another round for firing, wherein the method of operating comprises the steps of:

(a) supplying to the firearm in succession for firing a plurality of rounds of ammunition of the said size and external shape, each said round comprising a cartridge case of the said size and external shape, a quantity of combustible propellant material within the case and a bullet fitted at the forward end of the case to seal the propellant material within the case, the bullet consisting solely of a core of foamed polyurethane material and an external skin of unfoamed polyurethane, any space between the propellant material and the bullet being entirely free from solid material; and (b) firing in succession the rounds of ammunition by igniting the propellant material within the case to produce high energy gases which act directly upon the bullet to project the bullet from the case and to consume the bullet when projected therefrom.

* * * * *